US010191503B2

(12) United States Patent
Ogura

(10) Patent No.: US 10,191,503 B2
(45) Date of Patent: Jan. 29, 2019

(54) LINEAR REGULATOR WITH REDUCED OSCILLATION

(71) Applicants: KABUSHIKI KAISHA TOSHIBA, Tokyo (JP); TOSHIBA ELECTRONIC DEVICES & STORAGE CORPORATION, Tokyo (JP)

(72) Inventor: Akio Ogura, Kanagawa (JP)

(73) Assignees: KABUSHIKI KAISHA TOSHIBA, Tokyo (JP); TOSHIBA ELECTRONIC DEVICES & STORAGE CORPORATION, Tokyo (JP)

( * ) Notice: Subject to any disclaimer, the term of this patent is extended or adjusted under 35 U.S.C. 154(b) by 0 days.

(21) Appl. No.: 15/905,826

(22) Filed: Feb. 27, 2018

(65) Prior Publication Data

US 2018/0307259 A1 Oct. 25, 2018

(30) Foreign Application Priority Data

Apr. 25, 2017 (JP) ..... 2017-086239

(51) Int. Cl.

| | |
|---|---|
| ***G05F 1/575*** | (2006.01) |
| ***G05F 1/46*** | (2006.01) |
| *G05F 1/565* | (2006.01) |

(52) U.S. Cl.

CPC ..... *G05F 1/575* (2013.01); *G05F 1/468* (2013.01); *G05F 1/565* (2013.01)

(58) Field of Classification Search

CPC ..... G05F 1/565; G05F 1/575; G05F 1/467; G05F 1/562; G05F 1/462; G05F 1/465; G05F 1/468

See application file for complete search history.

(56) References Cited

U.S. PATENT DOCUMENTS

| | | | |
|---|---|---|---|
| 6,465,994 | B1 | 10/2002 | Xi |
| 6,522,111 | B2 | 2/2003 | Zadeh et al. |
| 8,054,052 | B2 | 11/2011 | Noda |
| 8,471,539 | B2 | 6/2013 | Wu |
| 8,810,219 | B2 | 8/2014 | Suzuki |

(Continued)

FOREIGN PATENT DOCUMENTS

| | | | |
|---|---|---|---|
| JP | 4937865 | B2 | 5/2012 |
| JP | 2012155395 | A | 8/2012 |

(Continued)

*Primary Examiner* — Harry Behm

(74) *Attorney, Agent, or Firm* — Patterson & Sheridan, LLP

(57) ABSTRACT

A power supply device has an input and output, a first transistor between the input and output, and a differential circuit responding to a difference between output voltage and a reference voltage with an output connected to a gate of the first transistor. A current monitoring circuit comprises a second input transistor with a gate connected to the gate of the first transistor and causes monitor current corresponding to current flow in the first transistor to flow. A comparator compares the monitor current to a reference and activates a switch to control a zero-point circuit which is connected between an output of the differential circuit and an input of the differential circuit and minimizes oscillation without the necessity of an output capacitor.

20 Claims, 6 Drawing Sheets

(56) References Cited

U.S. PATENT DOCUMENTS

| | | | | |
|---|---|---|---|---|
| 8,872,492 | B2 | 10/2014 | Zhang et al. | |
| 2013/0069608 | A1* | 3/2013 | Gakhar | G05F 1/575 323/273 |
| 2013/0234687 | A1* | 9/2013 | Fujimura | G05F 1/10 323/282 |
| 2014/0368176 | A1* | 12/2014 | Mandal | G05F 1/445 323/280 |
| 2017/0205840 | A1 | 7/2017 | Ogura | |
| 2018/0224876 | A1 | 8/2018 | Ogura | |

FOREIGN PATENT DOCUMENTS

| | | | |
|---|---|---|---|
| JP | 5694512 | B2 | 4/2015 |
| JP | 5821497 | B2 | 11/2015 |
| JP | 5828206 | B2 | 12/2015 |
| JP | 6038516 | B2 | 12/2016 |
| JP | 2017126259 | A | 7/2017 |

* cited by examiner

1

| | SW1: OFF (ZERO-POINT CIRCUIT 20: ABSENT) | SW1: ON (ZERO-POINT CIRCUIT 20: PRESENT) |
|---|---|---|
| LOAD CURRENT: ABSENT (SMALL) | CIRCUIT OPERATION: UNSTABLE | CIRCUIT OPERATION: STABLE |
| LOAD CURRENT: PRESENT (LARGE) | CIRCUIT OPERATION: STABLE PSRR: GOOD | CIRCUIT OPERATION: STABLE PSRR: DEGRADED |

1

LINEAR REGULATOR WITH REDUCED OSCILLATION

CROSS-REFERENCE TO RELATED APPLICATION

This application is based upon and claims the benefit of priority from Japanese Patent Application No. 2017-086239, filed Apr. 25, 2017, the entire contents of which are incorporated herein by reference.

FIELD

Embodiments described herein relate generally to a power supply device.

BACKGROUND

Constant voltage circuits such as linear regulators are provided in power supply devices used for electronic apparatuses. To stably operate without oscillation, a capacitor is added to an output of a constant voltage circuit in some cases. However, to achieve sufficient current driving abilities, the output capacitor has to be very large and the mounting area of the output capacitor has to be large. Accordingly, output capacitance requirements for this purpose may hinder efforts in miniaturization and cost reductions of constant voltage circuits. On the other hand, when an output capacitor is minimized or omitted altogether, stability of the constant voltage circuit suffers and oscillation easily occurs.

This problem is addressed by connecting amplifiers to phase compensation capacitors in constant voltage circuits, thereby forcing large phase compensation capacitances. In such a case, stability of a constant voltage circuit is improved, but high speed performance of the constant voltage circuit suffers. Thus, this technique may limit the frequency characteristics of the circuit. Furthermore high speed operation in a constant voltage circuit may result in increased current consumption.

DETAILED DESCRIPTION

An embodiment provides a power supply device that can stably operate and is capable of miniaturization.

In general, according to one embodiment, a power supply device includes a power supply input and a power supply output, a first transistor connected between the power supply input and the power supply output, a differential circuit having a first input corresponding to the power supply output voltage, a second input that receives a reference voltage, and an output connected to a gate of the first transistor, a current monitoring circuit comprising a second transistor connected to the power supply input with a gate connected to the gate of the first transistor, the second transistor causing a monitor current corresponding to current flow in the first transistor to flow, a comparator connected to the second transistor and compares monitor current from the second transistor to a reference current, a zero-point circuit which is connected between the output and the second input of the differential circuit, and displaces phase characteristics of the power supply to an opposite side of a pole of the phase characteristics of the power supply device, and a switch circuit which is between the zero-point circuit and the output or the second input of the different circuit and is activated based on a comparison result of the comparator.

Hereinafter, embodiments are described with reference to the drawings. However, these embodiments are exemplary only.

First Embodiment

Figure 1:
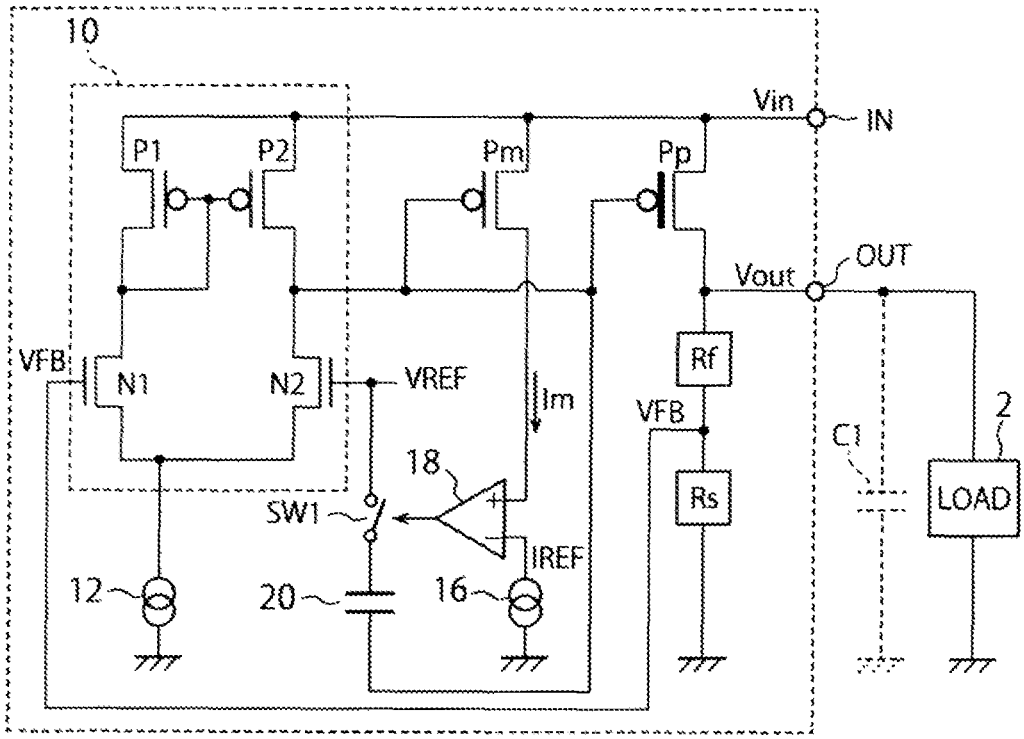
FIG. 1 is a circuit diagram illustrating a power supply device according to a first embodiment

FIG. 1 is a circuit diagram illustrating a configuration example of a power supply device 1 according to a first embodiment. The power supply device 1 may be, for example, a constant voltage power supply device such as, for example, a switching regulator or a linear regulator that supplies a predetermined constant voltage to a microcomputer, a sensor, a driver, or other device in a portable electronic apparatus driven by a battery. The power supply device 1 comprises a differential amplifier 10, a current source 12, a first transistor Pp, a second transistor Pm, a reference current source 16, a current comparator 18, a first switch circuit SW1, resistance elements Rf and Rs, and a zero-point circuit 20.

The differential amplifier 10 is part of a circuit that amplifies a difference in voltage between two input voltages VREF and VFB and includes, for example, transistors P1, P2, N1, and N2. The transistors P1 and P2 are p-type metal oxide semiconductor (MOS) transistors and have the same size (gate width (W)/gate length (L)). The transistors N1 and N2 are n-type MOS transistors and have the same gate size (W/L). Gates of the transistors P1 and P2 are connected to each other and are connected in common to a drain of the transistor P1. Sources of the transistors P1 and P2 are connected in common to an input terminal IN. In this way, the transistors P1 and P2 configure a mirror circuit and have the same sizes, and therefore flow substantially the same current to the transistors N1 and N2, respectively.

A drain of the transistor N1 is connected to a drain of the transistor P1. A feedback voltage VFB serves as a first voltage in accordance with an output voltage Vout from an output terminal OUT. VFB is applied to the gate of transistor N1. A drain of the transistor N2 is connected to a drain of the transistor P2. A predetermined reference voltage VREF serves as a reference of the feedback voltage VFB, and is applied to the gate of the transistor N2. Both sources of the transistors N1 and N2 are connected in common to the current source 12. The reference voltage VREF may be generated inside the power supply device 1 or may be generated outside.

An input node of the differential amplifier 10 is each of the gates of the transistors N1 and N2. For example, the gate of the transistor N1 functions as a first input of the differential amplifier 10 and receives the feedback voltage VFB, which serves as the first voltage. The gate of the transistor N2 functions as a second input of the differential amplifier 10 and receives the reference voltage VREF. An output node of the differential amplifier 10 is a connection node between the drain of the transistor N2 and the drain of the transistor P2. The output node of the differential amplifier 10 is connected to a gate of the first transistor Pp. The differential amplifier 10 receives as inputs the feedback voltage VFB and the reference voltage VREF as the input node, and outputs a voltage in accordance with a difference in voltage between the feedback voltage VFB and the reference voltage VREF from the output node. Thus, the differential amplifier 10 controls the first transistor Pp based on the feedback voltage VFB and the reference voltage VREF.

The current source 12 "first current source" is connected between the sources of the transistors N1 and N2 of the differential amplifier 10 and a ground that serves as a reference voltage source. The current source 12 is a constant current source that supplies a predetermined current to the differential amplifier 10.

The first transistor Pp is connected between the input terminal IN serving as a power input and an output terminal OUT serving as a power output. Transistor Pp outputs Vout in accordance with an input voltage Vin. The first transistor Pp is, for example, a p-type MOS transistor. A source of the first transistor Pp is connected to the input terminal IN, and a drain of the first transistor Pp is connected to the output terminal OUT. The gate of the first transistor Pp is connected to the output node of the differential amplifier 10.

The second transistor Pm is connected between the input terminal IN and the current comparator 18. The second transistor Pm causes a monitor current Im to flow in accordance with current flow in the first transistor Pp. The second transistor Pm is, for example, a p-type MOS transistor. A source of Pm is connected to the input terminal IN, and a drain of Pm is connected to a non-inversion input of the current comparator 18. A gate of the second transistor Pm is connected in common to an output of the differential amplifier 10 along with the gate of the first transistor Pp. The gates of the first transistor Pp and the second transistor Pm are connected in common and the sources of the first transistor Pp and the second transistor Pm are connected in common, and thus the first transistor Pp and the second transistor Pm substantially configure a current mirror circuit. Accordingly, the second transistor Pm causes a current substantially proportional to the current flowing in the first transistor Pp. The gate size (W/L) of the second transistor Pm is less than the gate size (W/L) of the first transistor Pp and the current flowing in the second transistor Pm is less than the current flowing in the first transistor Pp. Thus, the second transistor Pm is a replica of the first transistor Pp and can monitor the first transistor Pp with a lower consumption current.

The reference current source 16 is a current source that causes a reference current IREF to flow in the current comparator 18. The reference current IREF is a predetermined current serving as a threshold of the monitor current Im.

The non-inversion input of the current comparator 18 is connected to the drain of the second transistor Pm and the inversion input of the current comparator 18 is connected to the reference current source 16. An output of the current comparator 18 is connected to a first switch circuit SW1. The current comparator 18 compares the monitor current Im flowing in the second transistor Pm to the reference current IREF and controls switching of the first switch circuit SW1 based on a comparison result. For example, when the monitor current Im is less than the reference current IREF, the current comparator 18 switches on the first switch circuit SW1. When the monitor current Im exceeds the reference current IREF, the current comparator 18 switches off the first switch circuit SW1. In this case, the comparison result may be a 1-bit digital signal.

The first switch circuit SW1 is connected between the gate of the transistor N2 (a second input of the differential amplifier 10) and the zero-point circuit 20 and is controlled on and off according to the comparison result of the current comparator 18. An ON-state is an electrically conducted state and the OFF state is an electrically blocked state. The first switch circuit SW1 may be configured with, for example, a MOS transistor. When the first switch circuit SW1 is turned on, the zero-point circuit 20 is electrically connected to the second input of the differential amplifier 10 and the output of the differential amplifier 10. Conversely, when the first switch circuit SW1 is turned off, the zero-point circuit 20 is electrically disconnected from the second input of the differential amplifier 10 and the output of the differential amplifier 10. The first switch circuit SW1 may be connected between the zero-point circuit 20 and the output of the differential amplifier 10. Even in this case, the first switch circuit SW1 can electrically connect/disconnect the zero-point circuit 20 between the second input of the differential amplifier 10 and the output of the differential amplifier 10.

The zero-point circuit 20 is installed between the gate of the transistor N2 (the second input of the differential amplifier 10) and the output of the differential amplifier 10 and assigns a zero point to displace phase characteristics to the opposite side of displacement of the phase characteristics in a pole in the phase characteristics of the power supply device 1. That is, the zero-point circuit 20 functions to return (negate) the phase characteristics delayed by the pole. The displacement of the phase characteristics by the zero-point circuit 20 will be described in more detail later. The zero-point circuit 20 may be, for example, a capacitor connected between the second input of the differential amplifier 10 and the output of the differential amplifier 10. The capacitor may be a MOS capacitor installed on a common substrate with other transistors and the like.

The resistance elements Rf and Rs are connected in series between the drain (that is, the output terminal OUT) of the first transistor Pp and the ground. The resistance elements Rf and Rs divide the output voltage Vout to generate the feedback voltage VFB. A node between the resistance elements Rf and Rs is connected to the gate of the transistor N1 (that is, the first input of the differential amplifier 10). Thus, the feedback voltage VFB is fed back to the first input of the differential amplifier 10.

In the embodiment of FIG. 1, an output capacitor C1 is not connected to the output terminal OUT. Alternatively, due to action of the circuit of FIG. 1, the output capacitor C1 connected to the output terminal OUT is minimized. Accordingly, in FIG. 1, the output capacitor C1 is indicated by a dotted line.

Figure 2A:
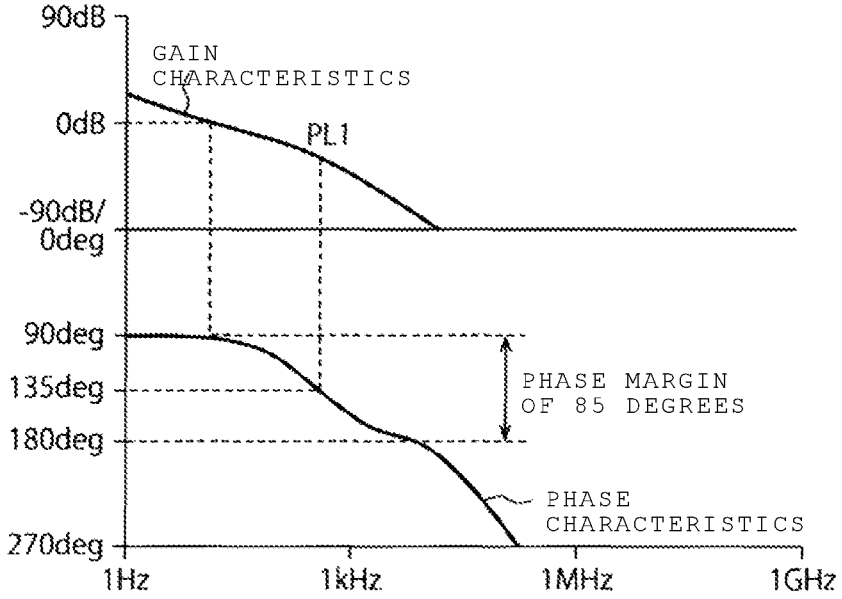
FIGS. 2A and 2B are graphs illustrating frequency characteristics of the power supply device according to the embodiment.
Figure 2B:
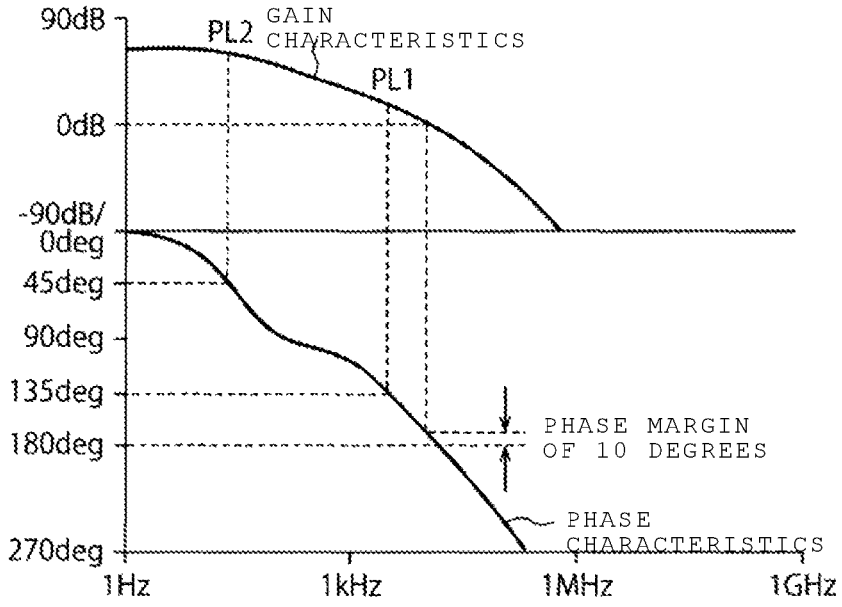

FIG. 2A graphically shows frequency characteristics of the power supply device in which a relatively large output capacitor (for example, about 1 micro F) is used. FIG. 2B is a graph illustrating frequency characteristics of the power supply device in which there is no output capacitance or a small output capacitance is used. To show influence of the output capacitance C1, the zero-point circuit 20 is assumed to be in an electrically disconnected state (the switch circuit SW1 is in an OFF state). A load current is assumed to be absent or very small.

The upper side of these graphs indicate a gain (open gain characteristics) and the lower side indicates phase characteristics. In general, as in the power supply device 1, stability of a circuit that has a feedback system is indicated by a phase margin. The phase margin indicates how phase characteristics deviate from 180 degrees when a gain is 1 (that is, 0 dB). At a gain of 1 (0 dB) and as phase characteristics further deviate from 180 degrees, the phase margin is larger and stability of the circuit operation due to the feedback system is improved. Usually, operation is deemed stable when the phase margin is about 45 degrees or more.

As illustrated in FIG. 2A, when the output capacitance C1 (for example, about 1 μF) is connected to the output terminal OUT, the phase margin is about 85 degrees and the power supply device 1 is sufficiently stable. Conversely, as illustrated in FIG. 2B, when the output capacitance C1 is not connected to the output terminal OUT, the phase margin is merely about 10 degrees and the power supply device 1 is unstable.

This is because the positions of two poles PL1 and PL2 of frequency characteristics are changed according to presence of output capacitance C1. The pole PL1 occurs by action of resistance of the first transistor Pp and capacitance of the output terminal OUT in FIG. 1. When Rp is the resistance of the first transistor Pp and Cout is the capacitance of the output terminal OUT, the pole PL1 occurs at the position of frequency fp1 (fp1=1(2πRp×Count)). The pole PL2 occurs by action of resistance of the transistor P2 and gate capacitance of the first transistor Pp. When R2 is the resistance of the transistor P2 and Cg is gate capacitance of the first transistor Pp, the pole PL2 occurs at the position of frequency fp2 (fp2=1(2πR2×Cg)). For example, the poles PL1 and PL2 occur at frequency positions where the phases are delayed at 135 degrees and 45 degrees, and the phase at each pole is delayed by about 90 degrees.

Here, when there is no output capacitance C1, as illustrated in FIG. 2B, the frequencies of the poles PL1 and PL2 relatively approach each other, and phase delay is fast. The beginning point of decreased gain is delayed. Accordingly, the phase margin decreases and the power supply device 1 becomes unstable (easily oscillates). Conversely, when the large output capacitance C1 is connected to the output terminal OUT, the frequency of the pole PL2 becomes very small (not illustrated in FIG. 2A) and deviation from the pole PL1 becomes large. Accordingly, the delay of the phase becomes gentle and the phase margin increases. Thus, the power supply device 1 becomes stable. This phase delay is phase delay of the feedback control of the power supply device 1. The fact that the delay of the phase is "fast" means that the degree of phase delay with respect to the frequency (an inclination of the graph of the phase characteristic) is large. The fact that the delay of the phase is "late" means that the degree of phase delay with respect to the frequency (an inclination of the graph of the phase characteristics) is small.

In this way, when the output capacitance C1 is connected to the output terminal OUT, the phase margin of the power supply device 1 increases despite absence of the load current, and thus the stability of the operation of the power supply device 1 is improved. However, as described above, the mounting area of the output capacitor C1 footprint is large, which interferes with miniaturization of the power supply device 1. Conversely, when the output capacitor C1 is minimized or absent, phase margin decreases in the absence of the load current, leading to unstable operation of the power supply device 1.

In this embodiment, even during absence of output capacitance C1 and in the absence of the load current, stability of the power supply device 1 is improved. This is seen in FIG. 3, with operation of the zero-point circuit 20.

Figure 3:
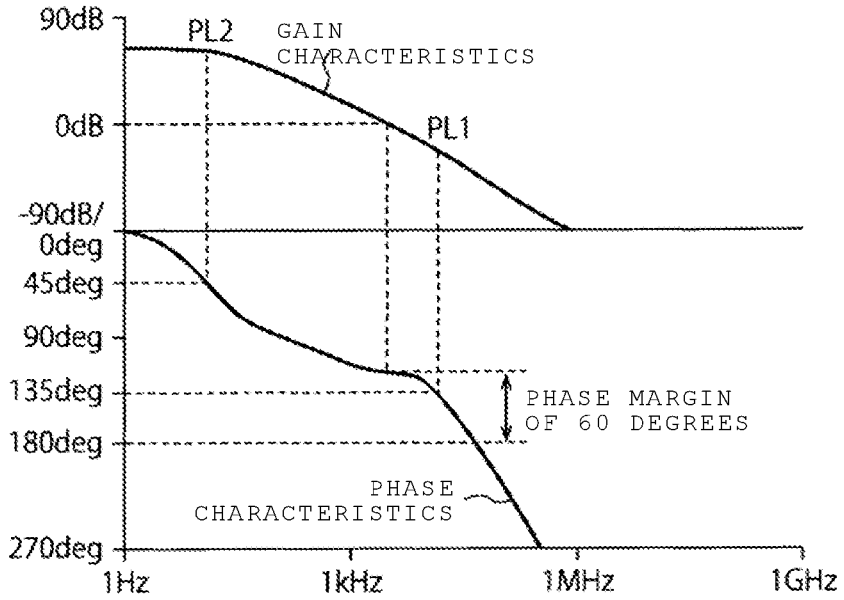
FIG. 3 is a graph illustrating frequency characteristics of the power supply device in which a zero-point circuit is installed.

FIG. 3 shows frequency characteristics of the power supply device with a functioning zero-point circuit 20. In FIG. 3, the zero-point circuit 20 is electrically activated (switch circuit SW1 is turned on) and output capacitor C1 is absent. The load current is assumed to be absent or very small.

In an embodiment, the zero-point circuit 20 is configured so that the zero-point is near the pole PL1 (near about 10 kHz) in FIG. 2B. In this case, delay of the pole PL1 phase can be returned (canceled) and the phase can progress. For example, at the pole PL1, the phase is delayed by 90 degrees and the phase is returned (progresses) by action of the zero-point. Accordingly, the phase margin at 0 dB gain increases. As seen from a comparison of FIG. 3 with FIG. 2B, the phase margin increases from about 10 degrees to about 60 degrees. Thus, operation of the power supply device 1 becomes stable.

In this way, by adding the zero-point circuit 20 between the output and the second input of the differential amplifier 10, it is possible to ensure the stability of the operation of the power supply device 1 even when the output capacitance C1 is absent or very small.

This advantage may be obtained in a high frequency band near 0 dB gain. Thus capacitance of the zero-point circuit 20 can be much smaller than that of output capacitor C1. For example, for an output capacitance C1 of 1 micro F, capacitance of the zero-point circuit 20 can be 10 pF. Accordingly, the addition of the zero-point circuit 20 does not hinder the miniaturization efforts for the power supply device 1.

Figure 4:
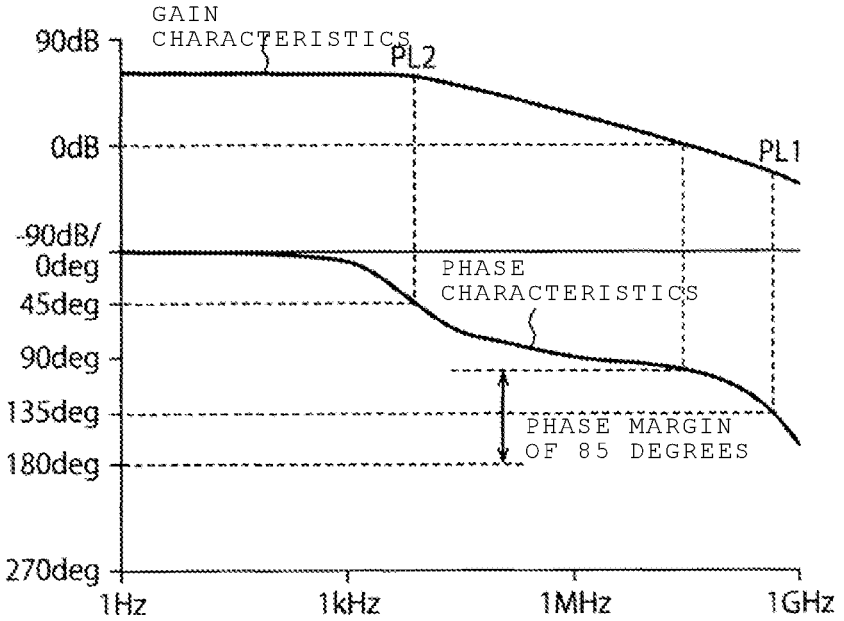
FIG. 4 is a graph illustrating frequency characteristics of the power supply device when a load current is large.

Conversely, when the load current is large, operation of the power supply device 1 becomes stable, as illustrated in FIG. 4, despite non-connection of the output capacitor C1 and the zero-point circuit 20.

FIG. 4 is a graph illustrating frequency characteristics of the power supply device when the load current is large. In FIG. 4, the zero-point circuit 20 is disconnected (the switch circuit SW1 is in an OFF state). The output capacitor C1 is missing.

When a load 2 is connected to the output terminal OUT or the load 2 is activated, a load current supplied from the output terminal OUT to the load 2 increases. In response, the first transistor Pp enters a strong ON state, causing a large load current. That is, the resistance Rp of the first transistor Pp becomes very small. Thus, as illustrated in FIG. 4, the frequency fp1 (fp1=1 (2πRp×Cout)) occurring at the pole PL1 is large and displaced to a high frequency side. As a result, the distance between the poles PL1 and PL2 increases, phase margin increases, and the power supply device 1 becomes stable. In this way, when the load current is large, the power supply device 1 becomes stable regardless of presence of an output capacitor C1 or a the zero-point circuit 20.

However, when the load current is large, there is a concern that power noise propagating from the input terminal IN to the gate of the first transistor Pp enters even the second input of the differential amplifier 10. This noise can transit via the zero-point circuit 20 when the zero-point circuit 20 is connected between the output and the second input of the differential amplifier 10. In this case, the power noise may mix with the reference voltage VREF and the reference voltage VREF may deviate from the predetermined constant voltage. When the reference voltage VREF is affected by the power noise in this way, the power supply device 1 may not output the constant output voltage Vout.

Usually, the power noise of the input voltage Vin is removed through feedback control of the power supply device 1 in the first transistor Pp. The noise removing ability of the power supply device 1 is characterized by a power supply rejection ratio (PSRR).

However, when the reference voltage VREF is affected by the power noise, the noise removing ability of the power supply device 1 deteriorates. That is, when the zero-point circuit 20 is connected, the PSRR characteristics of the power supply device 1 may degrade. Accordingly, when the load current is large, to preserve a favorable PSBR, it is preferable to electrically disconnect the zero-point circuit 20 between the output and the second input of the differential amplifier 10.

Figures 5, 6:
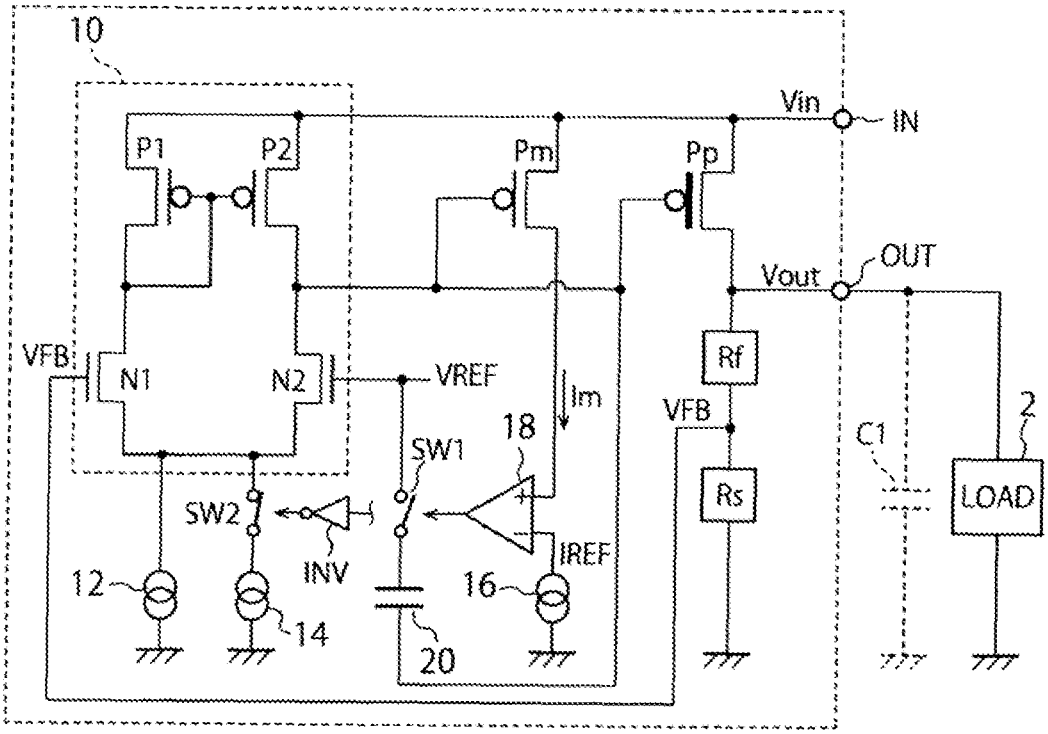
FIG. 5 is a table illustrating characteristics of the power supply device according to the first embodiment.
FIG. 6 is a circuit diagram of a power supply device according to a second embodiment.

The above-described characteristics of the power supply device 1 can be summarized as in FIG. 5.

FIG. 5 is a table illustrating characteristics of the power supply device 1 according to an embodiment as discussed. When the load current is absent or small, it is preferable to electrically connect the zero-point circuit 20 (i.e., turn on SW1) between the output and the second input of the differential amplifier 10, to maintain stability of operation. When the load current is present or large, it is preferable to electrically disconnect the zero-point circuit 20 (i.e., turn off SW1) from the output or the second input of the differential amplifier 10 switch circuit in consideration of the PSRR since stability of operation is ensured.

As described above, the power supply device 1 according to the embodiment includes the zero-point circuit 20 and the switch circuit SW1 connected in series between the output and the second input of the differential amplifier 10. Further, the current comparator 18 controls the switch circuit SW1 based on the ratio of monitor current to load current (output current). Thus, when the load current is absent or small, the current comparator 18 can turn on the switch circuit SW1. When the load current is large, the current comparator 18 can turn off the switch circuit SW1. That is, the power supply device 1 can switch the switch circuit SW1 according to the load current and can automatically electrically connect or disconnect the zero-point circuit between the output and the second input of the differential amplifier 10. Thus, the power supply device can operate in states indicated by diagonal lines illustrated in FIG. 5. Even when the output capacitor C1 is not provided, the power supply device 1 can stably operate. Since the output capacitance C1 is not necessary, the power supply size can be minimized.

Next, an operation of the power supply device 1 will be described.

First, as illustrated in FIG. 1, when the input voltage Vin is applied to the input terminal IN, the power supply device 1 is activated. When the source voltage of the first transistor Pp increases to become equal to or greater than a threshold voltage of the first transistor Pp over the gate voltage, the first transistor is turned on. When the first transistor Pp is turned on, the output voltage Vout is output from the output terminal OUT.

When the output voltage Vout is applied to the load 2, feedback voltage VFB from resister divider bridge Rf and Rs is fed back to the differential amplifier 10. The feedback voltage VFB can be calculated from the output voltage Vout across the resistance elements rf and rs. For example, when rf and rs are the respective values Rf and Rs, the feedback voltage VFB is expressed as Vout×rs/(rf+rs).

The differential amplifier 10 controls the gate voltage of the first transistor Pp such that the feedback voltage VFB is the same as the reference voltage VREF. For example, when the output voltage Vout is relatively high and the feedback voltage VFB is higher than the reference voltage VREF, the balance between currents flowing in the transistors N1 and N2 collapses because the current flowing in the transistor N2 is less than the current flowing in the transistor N1. On the other hand, since the current source 12 causes a constant current to flow in the differential amplifier 10 and the transistors P1 and P2 configure a current mirror as active loads, the transistors P1 and P2 cause substantially the same current to flow in the transistors N1 and N2. Accordingly, when the current flowing in the transistor N2 is less than the current flowing in the transistor N1, charges from the input terminal IN are accumulated on the drain side of the transistor N2 and the drain voltage (that is, the gate voltage of the first transistor Pp) of the transistor N2 increases. The first transistor Pp is a p-type transistor. Therefore, when the gate voltage of the first transistor Pp increases, the current flowing in the first transistor Pp decreases. Thus, the output voltage Vout decreases. In this way, when the output voltage Vout is higher than the reference voltage VREF, the power supply device 1 controls the first transistor Pp such that the output voltage Vout decreases, and thus the output voltage Vout is stabilized.

Conversely, when the output voltage Vout is relatively small and the feedback voltage VFB is lower than the reference voltage VREF, the current flowing in the transistor N2 is greater than the current flowing in the transistor N1. Accordingly, the charges on the drain side of the transistor N2 are pulled by the current source 12, and the drain voltage of the transistor N2 (that is, the gate voltage of the first transistor Pp) decreases. The first transistor Pp is a p-type transistor. Therefore, when the gate voltage of the first transistor Pp decreases, the current flowing in the first transistor Pp increases. Thus, the output voltage Vout increases. In this way, when the output voltage Vout is lower than the reference voltage VREF, the power supply device 1 controls the first transistor Pp such that the output voltage Vout increases, and thus the output voltage Vout is stabilized.

The first transistor Pp causes the load current to flow while under feedback control from the differential amplifier 10. When the first transistor Pp causes the load current to flow, the second transistor Pm causes the monitor current Im proportional to the current flowing in the first transistor Pp. For example, when the effective size of the second transistor Pm is 1/n (where n is an integer) of the effective size of the first transistor Pp, the second transistor Pm causes the monitor current Im of 1/n of the current flowing in the first transistor Pp.

The current comparator 18 compares the monitor current Im to the reference current IREF and controls the switch circuit SW1 based on the comparison result. For example, when the monitor current Im is lower than the reference current IREF, the current comparator 18 turns the switch circuit SW1 on to electrically connect the zero-point circuit 20 between the second input of the differential amplifier 10 and the output of the differential amplifier 10. Conversely, when the monitor current Im is higher than the reference current IREF, the current comparator 18 turns the switch circuit SW1 off to electrically disconnect the zero-point circuit 20 between the second input of the differential amplifier 10 and the output of the differential amplifier 10.

Thus, when the load current is less than a certain threshold (when the load 2 is in a shut-down state or a standby state), the zero-point circuit 20 is electrically connected between the output and the second input of the differential amplifier 10, and thus the power supply device 1 stably operates. When the load current exceeds the threshold (when the load 2 is activated), the zero-point circuit 20 is electrically disconnected from the output and the second input of the differential amplifier 10, the power supply device 1 stably operates and the PSRR characteristics are also good.

Second Embodiment

FIG. 6 is a circuit diagram of a power supply device according to a second embodiment. A power supply device 1 according to this embodiment differs from the power supply device 1 according to the first embodiment in that a current source 14 and a second switch circuit SW2 are further included. The remaining configuration details of the second embodiment generally are the same as that of the first embodiment.

The current source 14 serving as the second current source is installed between the ground and the sources of the transistors N1 and N2 of the differential amplifier 10. The current source 14 supplies the differential amplifier 10 with an additional current added to a current by the current source 12. The current source 12 supplies a minute current to the differential amplifier 10 to reduce current consumption. On the other hand, the current source 14 supplies current to the differential amplifier 10 in addition to the minute current from the current source 12. Thus, a relatively large current is supplied to the differential amplifier 10.

The second switch circuit SW2 is connected to the current source 14 and the sources of the transistors N1 and N2. SW2 is controlled in accordance with the comparison result of the current comparator 18. The second switch circuit SW2 may be configured with, for example, a MOS transistor. When the second switch circuit SW2 is turned on, the current source 14 is electrically connected between the ground and the sources of the transistors N1 and N2. Thus, the current source 14 can cause additional current to flow to the differential amplifier 10. Conversely, when the second switch circuit SW2 is turned off, the current source 14 is electrically disconnected between the ground and the sources of the transistors N1 and N2. Thus, only the current source 12 causes current flow to the differential amplifier 10. The second switch circuit SW2 may be connected between the ground and the current source 14. Even in this case, the second switch circuit SW2 can electrically connect/disconnect the current source 14 between the ground and the sources of the transistors N1 and N2.

The second switch circuit SW2 performs a complementary switching operation with the first switch circuit SW1. That is, when the first switch circuit SW1 is turned on, the second switch circuit SW2 is turned off. When the first switch circuit SW1 is turned off, the second switch circuit SW2 is turned on. For example, when the monitor current Im is less than the reference current IREF, the first switch circuit SW1 is turned on and the second switch circuit SW2 is turned off. When the monitor current Im exceeds the reference current IREF, the first switch circuit SW1 is turned off and the second switch circuit SW2 is turned on.

To achieve desirable operation, in an embodiment an inverter INV is installed between the second switch circuit SW2 and the output of current comparator 18. The inverter INV inputs inversion of the comparison result of the current comparator 18 to the second switch circuit SW2. Non-inversion of the comparison result of the current comparator 18 is input to the first switch circuit SW1. Thus, the first switch circuit SW1 and the second switch circuit SW2 can execute the complementary operations. When the inversion input and the non-inversion input of the current comparator 18 are switched, the inverter INV may be installed between the first switch circuit SW1 and the output of the current comparator 18.

Next, an operation of the power supply device 1 according to the second embodiment will be described.

Basic operations of the differential amplifier 10 and the first transistor Pp are the same as those according to the first embodiment.

The current comparator 18 compares the monitor current Im to the reference current IREF and controls the first switch circuit SW1 and the second switch circuit SW2 based on the comparison result. For example, when the load current is small and the monitor current Im is lower than the reference current IREF, the current comparator 18 turns the first switch circuit SW1 on to electrically connect the zero-point circuit 20 between the second input of the differential amplifier 10 and the output of the differential amplifier 10. The current comparator 18 turns the second switch circuit SW2 off to electrically disconnect the current source 14 from the differential amplifier 10. Thus, when the load current is small, only the minute current by the current source 12 flows in the differential amplifier 10. In this case, the operation of the differential amplifier 10 is delayed, but current consumption of the differential amplifier 10 decreases (a low current consumption mode). Accordingly, in the low current consumption mode, it takes some time to return the output voltage Vout to a predetermined voltage due to a sharp variation in the load current. That is, load transient characteristics are not good. However, since the zero-point circuit 20 functions, the stability of the operation of the power supply device 1 is maintained.

Conversely, when the monitor current Im is higher than the reference current IREF, the current comparator 18 turns the first switch circuit SW1 off to electrically disconnect the zero-point circuit 20 from the second input of the differential amplifier 10 and the output of the differential amplifier 10. The current comparator 18 turns the second switch circuit SW2 on to electrically connect the current source 14 between the ground and the differential amplifier 10. Thus, when the load current is large, the additional current by the current source 14 flows to the differential amplifier 10 in addition to the minute current by the current source 12. In this case, the charges can be rapidly pulled from the gate of the first transistor Pp having the larger capacitance. Accordingly, the current consumption of the differential amplifier 10 increases, but the power supply device 1 can operate at a high speed (a high speed operation mode). In the high speed operation mode, response performance of the differential amplifier 10 is improved. Even when the load current is varied sharply, the output voltage Vout can be returned to the predetermined voltage in a short time. That is, the so-called load transient characteristics are good. When the load current is large, as described in the first embodiment, the stability of the operation of the power supply device 1 is maintained even when the zero-point circuit 20 is absent. Accordingly, the zero-point circuit 20 is electrically disconnected from the differential amplifier 10 in consideration of the PSRR characteristics.

In this way, in the second embodiment, when the load current is large, the current source 14 supplies the additional current to the differential amplifier 10, so that the differential amplifier 10 can operate at a high speed. Conversely, when the load current is small, only the current source 12 supplies the minute current to the differential amplifier 10, so that the current consumption of the differential amplifier 10 can be decreased. That is, in the power supply device 1 according to the second embodiment, compatibility between the high speed operation and the low current consumption can be achieved.

Further, the power supply device 1 according to the second embodiment includes the zero-point circuit 20 connected to the differential amplifier 10 in accordance with load current as in the first embodiment. Accordingly, compatibility between the PSRR characteristics and the stability of the operation of the power supply device 1 can be achieved.

In other words, in the power supply device 1 according to the second embodiment, while stability is maintained, current consumption is reduced by the zero-point circuit 20 and the current source 14 complementarily connected to the differential amplifier 10. Thus, alternating current (AC) characteristics such as the PSRR characteristics or the load transient characteristics can be made good.

Third Embodiment

Figure 7:
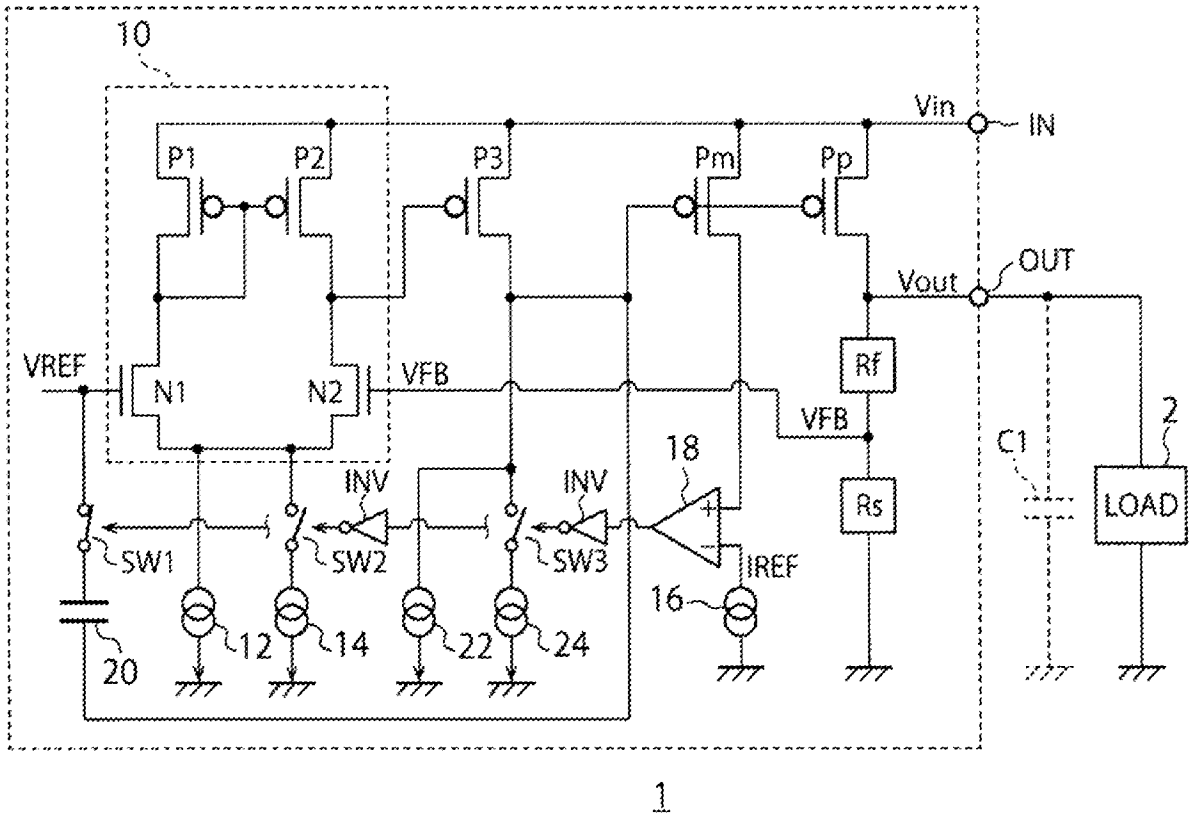
FIG. 7 is a circuit diagram of a power supply device according to a third embodiment.

FIG. 7 is a circuit diagram illustrating a configuration example of a power supply device according to a third embodiment. A power supply device 1 according to the third embodiment is different from the power supply device 1 according to the second embodiment in that a transistor P3, current sources 22 and 24, and a switch circuit SW3 are further included. The other configuration details of the third embodiment generally are the same as the corresponding configuration of the second embodiment.

A source of the third transistor P3, is connected to the input terminal IN and a gate is connected to the output of the differential amplifier 10. A drain (at another end) of the transistor P3 is connected to the gates of the first transistor Pp and the second transistor Pm and the current source 22. The drain of the transistor P3 is connected to a current source 24 via the switch circuit SW3.

The current source 22 serving as a third current source is connected between the ground and the drain of the transistor P3 and is a current source that supplies a minute current to the transistor P3 as in the current source 12.

The current source 24 serving as a fourth current source is connected in parallel to the current source 22 between the ground and the drain of the transistor P3 and is a current source that supplies an additional current to the transistor P3. The current source 22 supplies a minute current to the transistor P3 to minimize current consumption. On the other hand, the current source 24 supplies additional current to the transistor P3 in addition to the minute current from the current source 22. Thus, a relatively large current can be supplied to the differential amplifier 10.

The switch circuit SW3 serving as the third switch circuit is connected between the current source 24 and the drain of the transistor P3. SW3 is switched according to a comparison result of the current comparator 18. The switch circuit SW3 may be configured with, for example, a MOS transistor. When the switch circuit SW3 is turned on, the current source 24 is electrically connected between the ground and the drain of the transistor P3. Thus, the current source 24 can cause the additional current to flow to the transistor P3. Conversely, when the second switch circuit SW3 is turned off, the current source 24 is electrically disconnected between the ground and the drain of the transistor P3. Thus, only the current source 22 causes the current to flow to the transistor P3. The switch circuit SW3 may be connected between the ground and the current source 24. Even in this case, the switch circuit SW3 can electrically connect/disconnect the current source 24 between the ground and the drain of the transistor P3. The switch circuit SW3 operates as in the switch circuit SW2 and executes a complementary operation with the switch circuit SW1.

To achieve such an operation, for example, an inverter INV is installed between the switch circuits SW2 and SW3 and the output of the current comparator 18. The inverter INV inputs an inverted comparison result of the current comparator 18 to both the switch circuits SW2 and SW3. A non-inverted comparison result of the current comparator 18 is input to the first switch circuit SW1. Thus, the switch circuits SW2 and SW3 execute the same operation and execute the complementary operations with the switch circuit SW1. When the inversion input and the non-inversion input of the current comparator 18 are switched, the inverter INV may be installed between the first switch circuit SW1 and the output of the current comparator 18.

In the third embodiment, since the transistor P3 is a p-type transistor, the gate voltages of the first transistor Pp and the second transistor Pm are inverted with respect to the output voltage of the differential amplifier 10. Accordingly, two inputs of the differential amplifier 10 receiving the feedback voltage VFB and the reference voltage VREF are reversed to the inputs of the first and second embodiments.

Next, an operation of the power supply device 1 according to the third embodiment will be described.

In a low current consumption mode in which the load current is relatively small, the switch circuit SW3 is turned off along with the switch circuit SW2. Thus, the current source 22 causes a minute current to flow to the transistor P3 to reduce power consumption. In this case, the load transient characteristics are not good. However, since the zero-point circuit 20 functions, the stability of the operation of the power supply device 1 is maintained.

In a high speed operation mode in which the load current is relatively large, the switch circuit SW3 is turned on along with the switch circuit SW2. Thus, the current sources 22 and 24 cause the currents to flow to the transistor P3 to operate the first transistor Pp at a high speed. In this case, the current consumption of the power supply device 1 increases, but response performance of the power supply device 1 is improved, and thus the load transient characteristics are good. In this case, the zero-point circuit 20 is electrically disconnected from the differential amplifier 10 in consideration of the PSRR characteristics, but the stability of the operation of the power supply device 1 is maintained.

In the third embodiment, it is possible to obtain the same advantages as those of the second embodiment. Further, according to the third embodiment, the transistor P3 functions as an additional gain stage. Accordingly, an open gain of the power supply device 1 increases, and thus AC characteristics such as the PSRR characteristics can be improved.

The transistor P3, the current sources 22 and 24, and the switch circuit SW3 may be combined in the power supply device 1 according to the first embodiment. That is, the current source 14 and the switch circuit SW2 in FIG. 7 may be omitted.

Modification Examples

Figure 8:
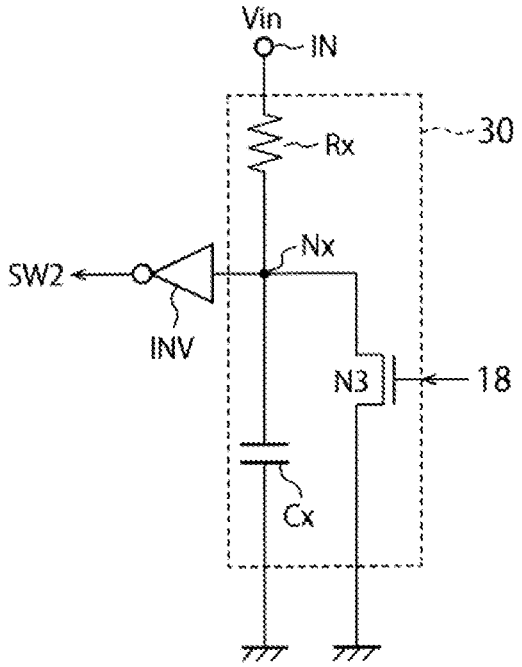
FIG. 8 is a circuit diagram of an extension circuit according to an embodiment related to the second and third embodiments.

FIG. 8 is an embodiment of an extension circuit according to the second and third embodiments. The low current consumption mode and the high speed operation mode according to the second and third embodiments are switched when the load current exceeds or is less than the reference current IREF.

However, when the high speed operation mode transitions to the low current consumption mode, an extension circuit 30 according to the modification example causes an additional current to continuously flow from a time point at which the load current is less than the reference current IREF until a predetermined extension period elapses. That is, the extension circuit 30 extends a signal based on a comparison result of the current comparator 18 to deliver the signal to the switch circuit SW2 when the switch circuit SW2 is switched off.

The extension circuit 30 is connected between the output of the current comparator 18 and the switch circuit SW2. The extension circuit 30 includes a transistor N3, a capacitor element Cx, and a resistance element Rx.

In the transistor N3 serving as a fourth transistor, a drain is connected to a node Nx and a source is connected to the ground. A gate of the transistor N3 is connected to the output of the current comparator 18. The transistor N3 is an n-type MOS transistor and is controlled based on a comparison result of the current comparator 18.

The capacitor element Cx is connected between the ground and the node Nx and accumulates charges from the input terminal IN to the node Nx when the transistor N3 is turned off. The charges accumulated in the capacitor element Cx flow (are opened) from the node Nx to the ground via the transistor N3 when the transistor N3 is turned on.

The resistance element Rx is connected between the input terminal IN and the node Nx and restricts flow of a charging current when the charges are accumulated in the capacitor element Cx. Thus, a charging time of the capacitor element Cx is an extension time in which the additional current flows when the high speed operation mode transitions to the low current consumption mode. That is, the extension time of the extension circuit 30 is determined in accordance with capacitance of the capacitor element Cx and a resistant value of the resistance element Rx.

Next, an operation of the power supply device 1 according to the embodiment will be described.

In the low current consumption mode, when the load current is small and the monitor current Im is lower than the reference current IREF, the current comparator 18 turns the first switch circuit SW1 on to electrically connect the zero-point circuit 20 between the second input of the differential amplifier 10 and the output of the differential amplifier 10. The current comparator 18 turns the transistor N3 off and the capacitor element Cx accumulates charges. Accordingly, the voltage of the node Nx becomes a high-level voltage. Thus, the extension circuit 30 turns the switch circuit SW2 off and the current source 14 electrically disconnects the current source from the differential amplifier 10.

When the power supply device 1 transitions from the low current consumption mode to the high speed operation mode, the monitor current Im is higher than the reference current IREF. Therefore, the current comparator 18 turns the switch circuit SW1 off to electrically disconnect the zero-point circuit 20 from the second input of the differential amplifier 10 or the output of the differential amplifier 10. The current comparator 18 turns the transistor N3 on to discharge capacitor element Cx via the transistor N3. At this time, the capacitor element Cx discharges for a short time, so that the voltage of the node Nx is changed from a high-level voltage to a low-level voltage rapidly. Thus, from a time point at which the monitor current Im is higher than the reference current IREF, the switch circuit SW2 is turned on without substantial delay, and the added current is supplied to the differential amplifier 10. That is, when the low current consumption mode transitions to the high speed operation mode, the extension circuit 30 turns the switch circuit SW2 on without substantial delay so that the added current starts without delay.

When the power supply device 1 transitions from the high speed operation mode to the low current consumption mode, the monitor current Im is lower than the reference current IREF. Therefore, the current comparator 18 turns the switch circuit SW1 on to electrically disconnect the zero-point circuit 20 from the second input of the differential amplifier 10 or the output of the differential amplifier 10. The current comparator 18 turns the transistor N3 off again to charge the capacitor element Cx. At this time, only a predetermined extension time is needed to accumulate charges from the input terminal IN to the capacitor element Cx via the resistance element Rx. Accordingly, the voltage of the node Nx gently increases after the transistor N3 is turned on. After the extension time elapses, the switch circuit SW2 is switched off. That is, when the high speed operation mode transitions to the low current consumption mode, the extension circuit 30 stops supplying the added current when the monitor current Im is less than the reference current IREF. After this the extension time period elapses.

In this way, according to the modification example, when the high speed operation mode transitions to the low current consumption mode, the extension circuit 30 does not immediately stop supplying the added current. Instead the extension circuit 30 stops supplying the added current after the extension time. Thus, even when the monitor current Im is greater than generally the reference current IREF, the power supply device 1 can maintain the high speed operation mode and prevent frequent transition between the high speed operation mode and the low current consumption mode. In this way stability of power supply device 1 can be enhanced.

When the high speed operation mode transitions to the low current consumption mode, the supply of the added current can be stopped after the zero-point circuit 20 is reliably connected to the differential amplifier 10. As a result, it is possible to maintain stability of power supply device 1.

The modification embodiment can be applied in reference to either the second or third embodiment.

In the first to third embodiments, the n-type transistors N1 and N2 provide input to the differential amplifier 10. However, instead of the n-type transistors N1 and N2, p-type transistors may be used. In this case, the feedback voltage VFB and the reference voltage VREF input to the differential amplifier 10 may be interchanged.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A power supply device comprising:

a power supply input and a power supply output;

a first transistor connected between the power supply input and the power supply output;

a differential circuit having a first input corresponding to the power supply output voltage, a second input that receives a reference voltage, and an output connected to a gate of the first transistor;

a current monitoring circuit comprising a second transistor connected to the power supply input with a gate connected to the gate of the first transistor, the second transistor causing a monitor current corresponding to current flow in the first transistor to flow;

a comparator connected to the second transistor and compares monitor current from the second transistor to a reference current;

a zero-point circuit which is connected between the output and the second input of the differential circuit, and displaces phase characteristics of the power supply to an opposite side of a pole of the phase characteristics of the power supply device; and a switch circuit which is between the zero-point circuit and the output or the second input of the differential circuit and is activated based on a comparison result of the comparator.

2. The power supply device according to claim 1, wherein the first transistor is a p-type MOS transistor with a source connected to the power supply input and a drain connected to the power supply output, and the second transistor is a p-type MOS transistor with a smaller sized gate than the first transistor.

3. The power supply device according to claim 1, wherein when the monitor current is less than the reference current, the switch circuit is turned on, and when the monitor current exceeds the reference current, the switch circuit is turned off.

4. The power supply device according to claim 1, wherein the zero-point circuit comprises a capacitor connected between the output of the differential circuit and the second input of the differential circuit.

5. The power supply device according to claim 4, wherein the capacitor is a MOS capacitor installed on a common substrate with other transistors.

6. The power supply device according to claim 5, wherein the power source device does not include an output capacitor connected between the output and ground.

7. The power supply device according to claim 1, wherein the power source device does not include an output capacitor connected between the output and ground.

8. The power supply device according to claim 1, further comprising:

a first current source between the differential circuit and ground, that supplies current to the differential circuit;

a second current source between the differential circuit and ground, that supplies current to the differential circuit; and a second switch circuit between the second current source and the differential circuit, that is activated based on a comparison result of the comparator.

9. The power supply device according to claim 8, wherein when the monitor current is less than the reference current, the second switch circuit is turned off, and when the monitor current exceeds the reference current, the second switch circuit is turned on.

10. The power supply device according to claim 1, further comprising:

a third transistor connected to control current flow between the power supply input and a third current source and to the gates of the first and second transistors, and having a gate connected to an output of the differential circuit.

11. The power supply device according to claim 10, further comprising:

an extension circuit connected between the comparator and the second switch circuit to prolong delivery of a signal to the second switch circuit when activating the second switch circuit to turn OFF.

12. The power supply device according to claim 11, wherein the extension circuit comprises a transistor having a gate that is activated by the comparator output and a capacitor connected between the output of the transistor and ground.

13. A regulated voltage power supply with an input and an output, comprising:

a transistor operably connected between the input and the output;

a differential circuit configured to compare a sensed output voltage with a reference voltage and control the transistor, thereby controlling current flow between input and output;

a current monitoring circuit configured to cause a smaller, mirror current to flow corresponding to the current flow between the input and output;

a zero-point circuit between an output of the differential circuit and an input of the differential circuit, that is configured to improve phase margin of the differential circuit sufficiently to hinder oscillation; and a comparator circuit configured to compare the mirror current with a reference current and activate the zero-point circuit via a first switch circuit based on a comparison result.

14. The regulated voltage power supply according to claim 13, wherein the zero-point circuit comprises a MOS capacitor.

15. The regulated voltage power supply according to claim 13, wherein when the mirror current is less than the reference current, the first switch circuit connects the zero-point circuit between an output and an input of the differential circuit and when the monitor current exceeds the reference current, the first switch circuit disconnects the zero-point circuit between an output and an input of the differential circuit.

16. The regulated voltage power supply according to claim 13, wherein the transistor is a p-type MOS transistor and is directly connected to the input and output.

17. The regulated voltage power supply according to claim 13, wherein the regulated voltage power supply does not include an output capacitor connected between the output and ground.

18. The regulated voltage power supply according to claim 13, further comprising:

a first current source between the differential circuit and ground, that supplies current to the differential circuit;

a second current source between the differential circuit and ground, that supplies current to the differential circuit; and a second switch circuit between the second current source and the differential circuit, that is activated based on a comparison result of the comparator.

19. The regulated voltage power supply according to claim 18, wherein when the first switch circuit is turned on, the second switch circuit is turned off, and when the first switch circuit is turned off, the second switch circuit is turned on.

20. The regulated voltage power supply according to claim 18, further comprising:

a third current source that constantly supplies current to the gate of the transistor, and a fourth current source that supplies current to the gate of the transistor under control of a third switch circuit that is controlled by the comparator circuit.

* * * * *